United States Patent [19]

Schoeber et al.

[11] Patent Number: 4,458,607

[45] Date of Patent: Jul. 10, 1984

[54] PROCESS AND BURNER FOR THE PARTIAL COMBUSTION OF FINELY DIVIDED SOLID FUEL

[75] Inventors: Willem J. A. H. Schoeber; Maarten J. van der Burgt, both of The Hague, Netherlands

[73] Assignee: Shell Oil Company, Houston, Tex.

[21] Appl. No.: 519,448

[22] Filed: Aug. 2, 1983

[30] Foreign Application Priority Data

Sep. 2, 1982 [GB] United Kingdom ..... 8225087

[51] Int. Cl.[3] ..... F23D 1/02

[52] U.S. Cl. ..... 110/347; 110/263; 110/264; 239/424

[58] Field of Search ..... 110/347, 263, 264, 265; 239/8, 416.5, 423, 424

[56] References Cited

U.S. PATENT DOCUMENTS

| | | | |
|---|---|---|---|
| 4,241,673 | 12/1980 | Smith et al. | 110/347 |
| 4,333,405 | 1/1982 | Michelfelder et al. | 110/347 X |
| 4,350,103 | 9/1982 | Poll | 110/264 |
| 4,367,686 | 1/1983 | Adrian | 110/347 |
| 4,421,039 | 12/1983 | Llinares | 110/263 |

*Primary Examiner*—Edward G. Favors

[57] ABSTRACT

A process and burner for the partial combustion of a finely divided solid fuel with oxygen.

A core of oxygen-containing gas and an annulus of finely divided solid fuel surrounding said core are introduced into a reactor space via a burner. The solid fuel is centrally introduced into the burner, whereas oxygen-containing gas is separately introduced into the burner outside the central solid fuel. In the burner the solid fuel is caused to flow outwardly and the oxygen-containing gas is caused to flow inwardly for supplying the solid fuel as an annulus around the oxygen-containing gas into the reactor space.

18 Claims, 8 Drawing Figures

FIG. 1
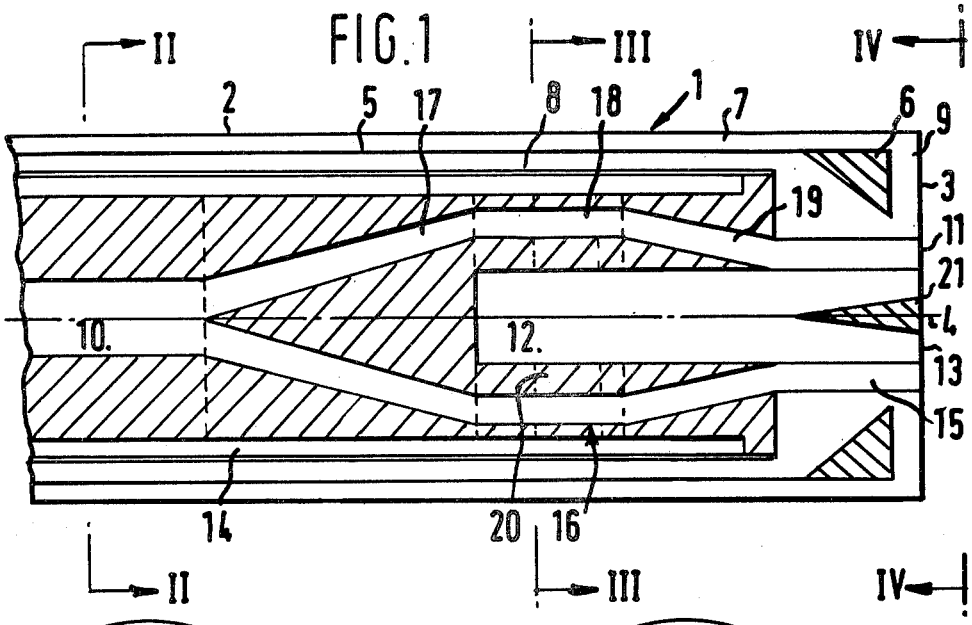
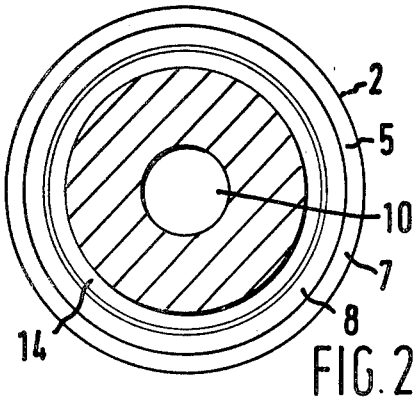
FIG. 2
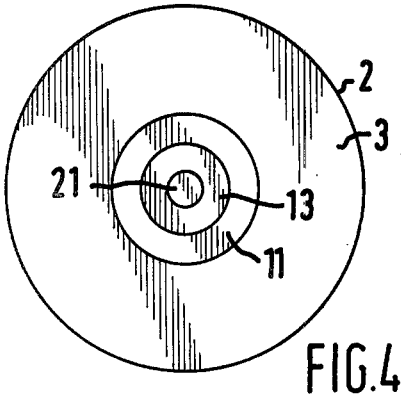
FIG. 4
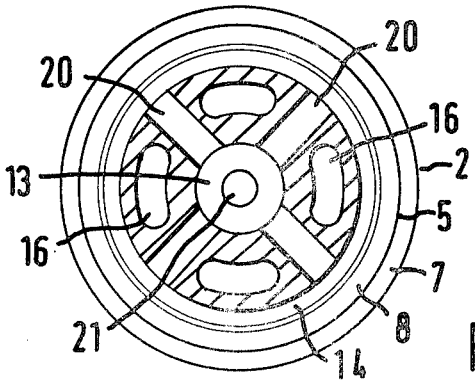
FIG. 3

FIG.5
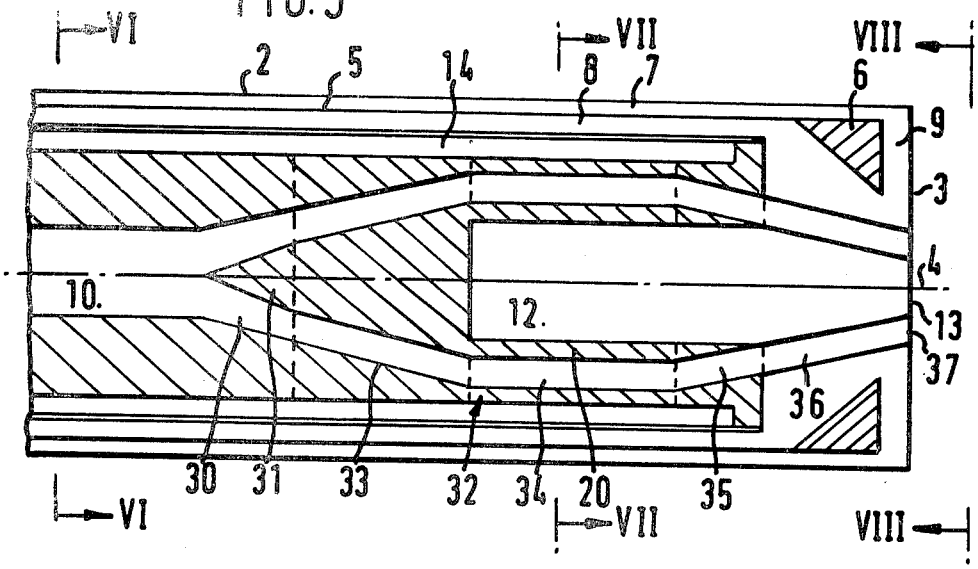
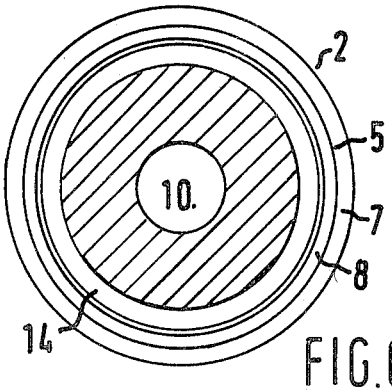
FIG.6
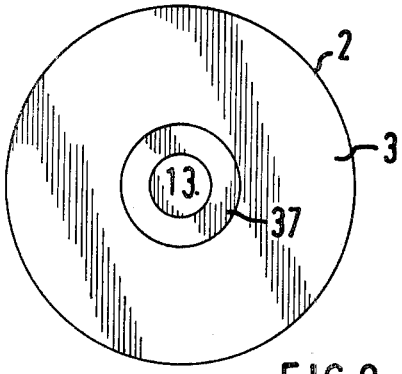
FIG.8
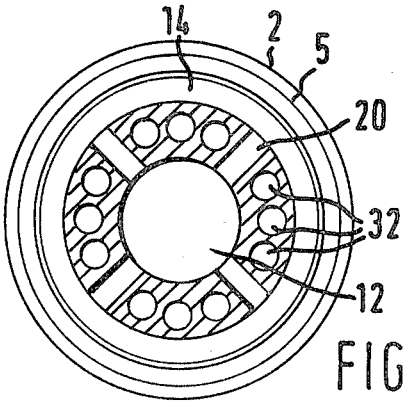
FIG.7

PROCESS AND BURNER FOR THE PARTIAL COMBUSTION OF FINELY DIVIDED SOLID FUEL

BACKGROUND OF THE INVENTION

The invention relates to a process for the partial combustion of finely divided solid fuel, such as pulverized coal, in which the latter is introduced together with oxygen-containing gas via a burner into a reactor space. The invention further relates to a burner for use in such a process for the partial combustion of finely divided solid fuel.

Partial combustion, also known as gasification, of a solid fuel is obtained by reaction of the solid fuel with oxygen. The fuel contains as useful components mainly carbon and hydrogen, which react with the supplied oxygen—and possibly with steam and carbon dioxide—to form carbon monoxide and hydrogen. Depending on the temperature, the formation of methane is also possible. While the invention is described primarily with reference to pulverized coal the process and burner according to the invention are also suitable for other finely divided solid fuels which can be partially combusted, such as lignite, pulverized wood, bitumen soot, and petroleum coke. In the gasification process the oxygen-containing gas may be pure oxygen or an oxygen-containing gas such as air or a mixture of air and oxygen can be used.

There are, in principle, two different processes for the partial combustion of solid fuel. In the first process, solid fuel in particulate form is contacted with an oxygen-containing gas in a reactor in a fixed or fluidized bed at temperatures below 1000° C. A drawback of this method is that not all types of solid fuel can be partially combusted in this manner, which limits the flexibility of the method. High swelling coal, for example, is unsuitable since particles of such a coal type easily sinter with the risk of clogging of the reactor. In some cases the high yield of methane obtained with this type of process is a disadvantage.

In a more advantageous process finely divided solid fuel is passed into a reactor at a relatively high velocity. In the reactor a flame is maintained in which the fuel reacts with oxygen-containing gas at temperatures above 1000° C. Contrary to the first gasification method, the residence time of the fuel in the reactor is in this method relatively short, in any way short enough to prevent sintering of the solid fuel. The last mentioned method is therefore suitable for the gasification of a relatively wide range of solid fuels.

In the latter process the solid fuel is usually passed in a carrier gas to the reactor via a burner, while oxygen-containing gas is also passed via the burner to the reactor. Since solid fuel, even when it is finely divided, is usually less reactive than atomized liquid fuel or gaseous fuel, great care must be taken in the manner in which the fuel and oxygen are mixed. If the mixing is insufficient, zones of underheating are generated in the reactor next to zones of overheating, caused by the fact that part of the solid fuel does not receive sufficient oxygen and another part of the fuel receives too much oxygen. In zones of underheating the fuel is not completely gasified, while in zones of overheating the fuel is completely converted into less valuable products, viz. carbon dioxide and water vapor. Local high temperatures in the reactor have a further drawback in that damage is caused to the refractory lining which is normally arranged at the inner surface of the reactor wall.

A primary requirement for obtaining a sufficient mixing of the solid fuel with oxygen throughout the gasification process is a stable supply of solid fuel to the burner fuel outlet. The supply of solid fuel should, moreover, be uniformly distributed over the total fuel outlet, whereas oxygen-containing gas should be supplied uniformly to the flow of solid fuel, to generate an intimate and uniform contact of oxygen with the solid fuel.

Further care should be taken to prevent damage to the burner front caused by the heat load during the gasification process. To protect the burner front from overheating it is necessary to prevent premature contact near the burner front of the supplied oxygen with already formed carbon monoxide and hydrogen in the reactor, which contact would result in a hot flame front at the burner front.

SUMMARY OF THE INVENTION

An object of the present invention is to provide a process for the partial combustion of a finely divided solid fuel, wherein the solid fuel is supplied via a burner to the reactor in such a manner that a sufficient mixing of the solid fuel with oxygen is obtained to guarantee an optimal partial combustion of solid fuel, and wherein overheating of the burner front by premature mixing of oxygen with the gas mixture already formed in the reactor is prevented.

A further object of the present invention is to provide a burner for the partial combustion of finely divided solid fuel with which the above objectives can be obtained.

The process for the partial combustion of a finely divided solid fuel thereto comprises according to the invention supplying oxygen-containing gas into a reactor space and introducing a finely divided solid fuel as an annulus around the oxygen-containing gas, the finely divided solid fuel and the oxygen-containing gas being introduced into the reactor space via a burner, wherein the finely divided solid fuel is introduced into a central channel of the burner and the oxygen-containing gas is separately introduced into the burner outside the central channel, and wherein in the burner the oxygen-containing gas is caused to flow in lateral inward direction and the solid fuel from the central channel is caused to flow in lateral outward direction for supplying the solid fuel as an annulus around the oxygen-containing gas into the reactor space.

In order to meet the aforementioned objectives the burner for the partial combustion of a finely divided solid fuel according to the invention comprises a central outlet for oxygen-containing gas, a substantially annular outlet substantially concentrically surrounding the central outlet for a finely divided solid fuel, a first central channel communicating with the annular outlet, a second central channel provided with an open end forming the central outlet, the first central channel and the second central channel having substantially coinciding longitudinal axes and being axially spaced apart from one another, a third channel for oxygen-containing gas arranged outside and being in longitudinal alignment with the first and the second central channel, wherein the first central channel is in communication with the annular outlet via a plurality of first connecting conduits, substantially uniformly distributed with respect to the first central channel, forming a smooth passage for the finely divided solids and being at least partly displace in lateral outward direction with respect to the first central channel, to form a space between a pair of adjacent first conduits and wherein the third channel is in communication with the second central channel via at least one second connecting conduit passing through the space between a pair of adjacent first connecting conduits.

In a suitable embodiment of the invention the total cross-sectional area of the first connecting conduits and the area of the outlet are each substantially equal to the cross-sectional area of the first central channel.

In the process and burner according to the invention, the solid fuel is introduced into a reactor space as an annulus around the oxygen-containing gas thereby forming a shield preventing the premature mixing near the burner front face of oxygen with the gas mixture already present in the reactor space.

The flow of solid fuel centrally supplied into the burner is smoothly guided in lateral outward direction via connecting channels allowing the oxygen to flow inwardly towards the central outlet without disturbing the solid fuel flow.

BRIEF DESCRIPTION OF THE DRAWINGS

The invention will now be described in more detail by way of example only with reference to the accompanying drawings, wherein:

FIG. 1 shows a longitudinal section of the front part of a first burner according to the invention.

FIG. 2 shows cross-section II—II of FIG. 1.

FIG. 3 shows cross-section III—III of FIG. 1.

FIG. 4 shows front view IV—IV of FIG. 1.

FIG. 5 shows a longitudinal section of the front part of a second burner according to the invention.

FIG. 6 shows cross-section VI—VI of FIG. 5.

FIG. 7 shows cross-section VII—VII of FIG. 5.

FIG. 8 shows front view VIII—VIII of FIG. 5.

DESCRIPTION OF THE PREFERRED EMBODIMENTS

It should be noted that identical elements shown in the drawings have been indicated with the same reference numeral.

Referring to the FIGS. 1 through 4, a burner, generally indicated with reference numeral 1, for the partial combustion of a finely divided solid fuel, such as pulverized coal, comprises a cylindrical hollow wall member 2 having an enlarged end part forming a front face 3 which is normal to the longitudinal axis 4 of the burner. The hollow wall member 2 is interiorly provided with a concentric wall 5 having an enlarged end part 6 arranged close to the burner front face 3. The concentric wall 5 serves to divide the interior of the hollow wall member 2 into passages 7 and 8 and a transition passage 9 for cooling fluid supplied into and discharged from the interior of the wall member 2 via not shown conduit means. The hollow wall member 2 encompasses a first central channel 10 for finely divided solid fuel, being in communication with an annular outlet 11, and a second central channel 12 having a free end forming an outlet 13 for oxygen-containing gas. The first central channel 10 and the second central channel 12 are axially spaced apart from one another, and are concentrically arranged with respect to one another. The hollow wall member 2 further encloses a first annular channel 14 for oxygen-containing gas, which channel 14 is concentrically arranged around the first central channel 10 and part of the second central channel 12, and a second annular channel 15 concentrically surrounding part of the second central channel and having an open end forming the annular outlet 11 for finely divided solid fuel. The first central channel 10 is in communication with the annular channel 15 and the annular outlet 11 via a plurality of connecting conduits 16, each in the shape of an annulus-segment, as shown in FIG. 3. The connecting conduits 16 are each composed of a laterally outwardly inclined part 17, a part 18 substantially in longitudinal alignment with the first central channel and a laterally inwardly inclined part 19 connected to the annular channel 15. At the junctions with the first central channel 10 to the connecting conduits 16 form together an annulus allowing a smooth passage of solid fuel from the channel 10 into the connecting conduits 16. Due to the inclination of the first parts 17 of the connecting conduits 16, spaces are gradually formed between adjacent conduits, which spaces are used for the arrangement of fluid communications between the annular channel 14 and the second central channel 12. Thereto a plurality of connecting conduits 20 pass through the spaces between the connecting conduits 16. The last element shown in FIG. 1 is a bluff body 21 for directing fluid from the outlet 13 in lateral outward direction and increasing the fluid velocity. The bluff body is centered in the second central channel 12 via spacer means (not shown).

During operation of the above described burner 1 for the gasification of pulverized coal by means of oxygen-containing gas, pulverized coal suspended in a carrier fluid is passed through the first central channel 10, and via the connecting conduits 16 and the annular channel 15 to the annular outlet 11 for introducing the coal into a reactor space arranged downstream of the burner. The term oxygen-containing gas is understood to include both substantially pure oxygen and gases such as air that contain oxygen or a mixture of air plus oxygen. Simultaneously, the oxygen-containing gas is passed through the annular channel 14, outside the solid fuel flow and via the connecting conduits 20 through the second central channel 12 to the central outlet 13. Near the central outlet 13 the oxygen-containing gas is caused to flow at an increased velocity in lateral outward direction due to the presence of the bluff body 21. As a result thereof the outflowing oxygen-containing gas is forced toward the annulus of outflowing coal, so that the coal will be intensively mixed with the oxygen-containing gas in the reactor space. The mixing of oxygen-containing gas and coal can be further promoted by a swirling motion of the oxygen-containing gas, for example generated by a swirl body (not shown) in the second central channel 12. The annulus of outflowing coal forms a shield protecting the burner front face from becoming overheated by premature contact between oxygen-containing gas and the gas mixture already formed in the reactor space. The width of the annular outlet 11 should be sufficiently narrow to allow a fast mixing of the coal and oxygen-containing gas in the reactor space. On the other hand, the annular outlet 11 should have a sufficient width for obtaining a stable outflow of coal. A suitable width of the annular outlet 11 for coal is chosen within the range of between 3 and 20 mm. An even more suitable width of the outlet 11 is between 3 and 10 mm. The flow stability of the coal entering the reactor space might be further improved by generating a swirling motion in the coal flow, for example by means of baffles (not shown) arranged in the annular channel 15.

For obtaining a smooth flow of the coal from the central channel 10 into the connecting conduits 16, a suitable acute angle of the parts 17 of said conduits 16 with the longitudinal axis 4 is chosen smaller than 45 degrees. An even more suitable angle of inclination is chosen smaller than 15 degrees. In order to promote a uniform and stable mass flow of the coal over the length of the burner, the cross-sectional area available for the coal flow is chosen preferably substantially constant over at least the front part of the burner.

Reference is now made to FIGS. 5–8, showing a further embodiment of the invention.

In this second example of a burner according to the invention the first central channel 10 is provided with an enlarged end part 30 internally provided with a centrally arranged deflecting member 31, forming an annular passage for solid fuel in the end part of the first central channel 10. The apex angle of the frustum shaped end part 30 is suitably smaller than 90 degrees and even more suitably smaller than 30 degrees, allowing a smooth transport of the solid fuel into the enlarged end part 30. The annular passage forms a smooth fluiding for solid fuel from the central channel 10 into a plurality of connecting conduits 32 having a first inclined part 33 arranged in line with said annular passage. The connecting conduits 32 are further composed of a part 34 parallel to the central channel 10 and a second inclined part 35 for directing the solid fuel towards an annular, frustum shaped channel 36 having an open end 37 forming the annular outlet for the solid fuel. As shown in FIG. 7, the connecting conduits 32 are so arranged relative to one another that spaces are formed between four pairs of adjacent conduits 32. In these spaces the connecting conduits 20 between the annular channel 14 and the second central channel 12 are arranged. The frustum shaped channel 36 may be further provided with swirling means (not shown) for generating a swirling motion in the solids flow in order to promote the mixing of solids and oxygen passed through the outlet 37 with oxygen from the outlet 13.

During operation of the burner shown in the FIGS. 5–8, for the gasification of coal with oxygen-containing gas, pulverized coal in a carrier liquid is transported through the first central channel 10, via the annular passage in the enlarged end part 30 of said channel and the connecting conduits 32 into the frustum shaped channel 36 and via the open end 37 of said channel 36 into a reactor space arranged downstream of the burner outlet. Simultaneously, oxygen-containing gas is caused to flow through the annular channel 14 and via the connecting conduits 20 passing through the spaces left free between the connecting conduits 32 into the second central channel 12 and via the central outlet 13 into the reactor space, where the coal is mixed with the oxygen-containing gas for the purpose of gasification. The coal leaving the frustum shaped channel 36 is directed toward the central outflow of oxygen-containing gas, causing an intensive contact between the coal and the oxygen. Since coal is supplied around the oxygen-containing gas flow, overheating of the burner front face due to premature contact between oxygen and reactor gases is prevented.

The cross-sectional area available for the coal flow should preferably be kept constant over at least the part of the burner near the outlet to promote a stable outflow of coal.

It should be noted that although an annular channel 14 for oxygen-containing gas is shown in the drawings, the invention is not restricted to the application of such an annular channel in the proposed burners. The oxygen-containing gas may, for example, be transferred to the second central channel 12 via a plurality of channels arranged outside the first central channel and provided with inwardly inclined parts forming the connecting conduits 20.

Further, it is remarked that the outlet for the solid fuel does not need to have exactly the shape of an annulus. It is also possible to have the outlet for solid fuel formed of the open ends of the connecting conduits for solid fuel themselves provided that these ends are substantially uniformly distributed around the oxygen-containing gas outlet and are relatively closely packed so that the open ends form a substantial annulus, required for forming a proper shield around the outflowing oxygen-containing gas.

The invention is not restricted to particular means for controlling the heat load of the burner. Instead of the shown hollow wall member with internal cooling fluid passages, the burner may, for example, be provided with a suitable refractory lining applied onto the outer surface of the burner front wall for resisting the heat load during operation of the burner.

For high duty operations the channels and conduits for oxygen-containing gas which are usually made of metal are preferably internally coated with an oxydic coating, such $ZrO_2$, or a ceramic, enabling the application of high oxygen-containing gas velocities without the risk of metal combustion by the oxygen.

Finally, it is noted that the bluff body 21 used in the embodiment of the invention shown in the first four figures is mainly of advantage in high capacity burners.

What is claimed is:

1. A process for the partial combustion of finely divided solid fuel comprising:

supplying oxygen-containing gas to a reactor space as the central discharge of a burner;

supplying finely divided fuel to the reactor as an annular discharge from the burner surrounding the central discharge, the finely divided fuel being supplied to said burner initially as a central flow and caused to flow laterally outward to form an annular flow around the oxygen-containing gas that is initially introduced as an annular flow surrounding said flow of finely divided fuel and then caused to flow laterally inward to form the central discharge of the burner.

2. A process as recited in claim 1, wherein the solid fuel is introduced into the reactor space at an acute angle with respect to the supplied oxygen-containing gas.

3. A process as recited in claim 1 or 2, wherein the solid fuel is introduced into the reactor space in a lateral inward direction with respect to the supplied oxygen-containing gas.

4. A process as recited in claim 1 or 2, wherein the oxygen-containing gas is introduced into the reactor space in a lateral outward direction with respect to the supplied solid fuel.

5. A process as recited in claim 1 or 2, wherein a swirling motion is imparted to the solid fuel.

6. A process as recited in claim 1 or 2, wherein a swirling motion is imparted to the oxygen-containing gas.

7. A process as recited in claim 1 or 2, wherein the annulus of solid fuel supplied into the reactor space has a width in the range of 3–20 mm.

8. A process as recited in claim 7, wherein the width is in the range of 3–10 mm.

9. A burner for the partial combustion of a finely divided solid fuel comprising:

a central outlet for the oxygen-containing gas;

a substantially annular outlet substantially concentrically surrounding the central outlet for the finely divided solid fuel;

a first central channel, a series of connecting axial conduits uniformly distributed with respect to said first central channel, and laterally spaced therefrom, said axial conduits connecting said first central channel with said annular outlet;

a second central channel coaxial with said first central channel and axially spaced therefrom, the open end of said second central channel forming said central outlet; and a third channel, said third channel being disposed to surround said first channel and connected by a series of radial conduits with said second channel to supply oxygen-containing gas to said second channel, said radial channels passing through the space between adjacent axial conduits.

10. A burner as recited in claim 9, wherein the total cross-sectional area of the first connecting axial conduits, the cross-sectional area of the first central channel and the cross-sectional area of the annular outlet are substantially equal.

11. A burner as recited in claim 9 or 10, wherein the third channel is substantially annular and is substantially concentrically arranged with respect to the first and the second central channel.

12. A burner as recited in claim 9 or 10, wherein the first central channel is provided with a frustum shaped end part interiorly provided with a deflecting element for smoothly guiding solid fuel from the central channel into the first connecting axial conduits.

13. A burner as recited in claim 9 or 10, wherein the first connecting axial conduits each form a communication between the first central channel and an annular outlet channel being open at one end to form the annular outlet.

14. A burner as recited in claim 13, wherein the annular outlet channel and the second central channel are substantially concentrically arranged with respect to one another.

15. A burner as recited in claim 14, wherein the annular outlet channel is substantially frustum shaped tapering towards the annular outlet.

16. A burner as recited in claim 9, 10, 14 or 15, wherein the second central channel is provided with a substantially centrally arranged bluff body making the central outlet of an annular shape.

17. A burner as recited in claim 9, 10, 14 or 15, wherein the annular outlet has a width in the range of 3–20 mm.

18. A burner as recited in claim 17, wherein the width is in the range of 3–10 mm.

* * * * *